United States Patent [19]

Cook

[11] Patent Number: 4,926,718

[45] Date of Patent: May 22, 1990

[54] NAIL HOLDING TOOL

[75] Inventor: Graham R. Cook, Britannia Beach, Canada

[73] Assignee: Clifford Lawrence Goodman, Britannia Beach, Canada

[21] Appl. No.: 321,643

[22] Filed: Mar. 8, 1989

[51] Int. Cl.[5] ..... B25C 3/00

[52] U.S. Cl. ..... 81/44; 81/177.3; 81/487

[58] Field of Search ..... 81/44, 177.3, 487, 23, 81/24; 223/109 R, 109 A; 294/25

[56] References Cited

U.S. PATENT DOCUMENTS

| | | | |
|---|---|---|---|
| 1,174,887 | 3/1916 | Meriwether | 223/109 A |
| 2,348,962 | 5/1944 | Davis | 294/25 |
| 2,420,869 | 5/1947 | Davis | 81/44 |
| 2,491,860 | 12/1949 | Ingraham | 81/487 X |
| 3,729,035 | 4/1973 | Manzanarez | 81/44 |
| 4,201,258 | 5/1980 | Elmore et al. | 81/44 |
| 4,520,997 | 6/1985 | Lorton, Sr. | 81/44 X |

FOREIGN PATENT DOCUMENTS

| | | | |
|---|---|---|---|
| 52-51181 | 4/1977 | Japan | 81/44 |

*Primary Examiner*—D. S. Meislin

*Attorney, Agent, or Firm*—Klarquist, Sparkman, Campbell, Leigh & Whinston

[57] ABSTRACT

A nail holding tool comprises an impact resistant sheath adapted to fit snugly over a user's thumb, and a nail holding fixture supported by the sheath for holding a nail below the tip of the thumb in a position substantially transverse to the axis of the thumb. The fixture may comprise a groove in the wall of the sheath and a magnet for attracting and holding a nail in the groove.

4 Claims, 2 Drawing Sheets

NAIL HOLDING TOOL

FIELD OF THE INVENTION

This invention relates to hand held tools and, more specifically, to a nail holding tool which is carried by the human thumb.

DESCRIPTION OF THE PRIOR ART

Various tools have been devised to assist and to protect a user when hammering nails. Examples of such tools include the combination nail and tack holders and finger guards disclosed in U.S. Pat. No. 2,348,962 granted on May 16, 1944 to Davis, and in U.S. Pat. No. 2,420,869 granted on May 20, 1947, also to Davis. Both of these patents disclose thimble-like devices with a fixture at the end of the tip designed to hold a nail in alignment while being driven.

The specific embodiments illustrated in the patents to Davis show the thimble portion as fitting over a user's middle finger.

A similar concept is disclosed in U.S. Pat. No. 2,491,860 granted to Ingraham on Dec. 20, 1949. In one embodiment, Ingraham contemplates a non-protective thimble-like device with a magnetic head positioned at the tip. The tool is non-protective in that Ingraham prefers the body portion to be made of an elastic material which would not appear to offer any protection against misdirected hammer blows. This embodiment, as illustrated in the patent to Ingraham, shows the body portion slipped over a user's forefinger with the magnetic head facing outwardly away from the finger tip.

Such devices are useful, but they are also limited in their contribution to manual dexterity. There are constraints on the ease with which a user can position a nail in the nail holder, and on the quickness with which a user can move from one nail to the next.

SUMMARY OF THE INVENTION

It is a principal object of the present invention to provide a new and improved nail holding tool which not only serves to protect the user and to assist in aligning nails, but which also enables enhanced manual dexterity in the handling of nails.

Accordingly, in accordance with a broad aspect of the present invention, there is provided a nail holding tool comprising an impact resistant sheath adapted to fit snugly over a user's thumb, and a nail holding fixture supported by the sheath for holding a nail below the tip of the thumb in a position extending substantially transverse to the axis of the thumb, the sheath permitting movement of the thumb between a position extending away from the user's hand and a position extending across the palm region of the user's hand.

In a preferred embodiment, the nail holding fixture comprises an elongated groove in an outer wall surface of the sheath with a magnetic means at the bottom of the groove. The magnetic means serves to attract and hold a nail; the groove serves to align the nail.

It may be observed that the magnetic nail holder of Ingraham also serves to attract a nail into a groove, and that the groove serves to provide alignment. However, the position of alignment is quite different from that of the present invention.

With the position of alignment called for by the present invention, it is possible for a user to carry a bundle of nails in the palm of his hand and, with the nail holding tool on the thumb of the same hand, to quickly pick up such nails one-by-one, and hammer them in the desired nailing points. The design of Ingraham with the nail holding fixture positioned beyond the tip of a finger simply does not admit to this dexterity.

The invention and its features and advantages will now be described in more detail with reference to the drawings.

DETAILED DESCRIPTION

Figure 4:
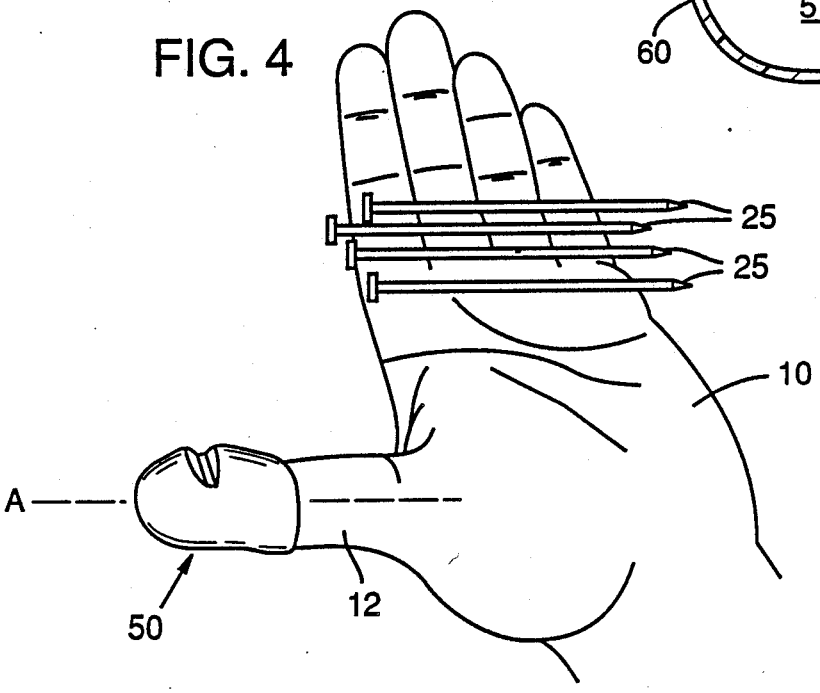
FIG. 4 is a perspective of the tool shown in FIG. 1 when positioned on a user's thumb, the thumb extending away from the user's hand.
Figure 5:
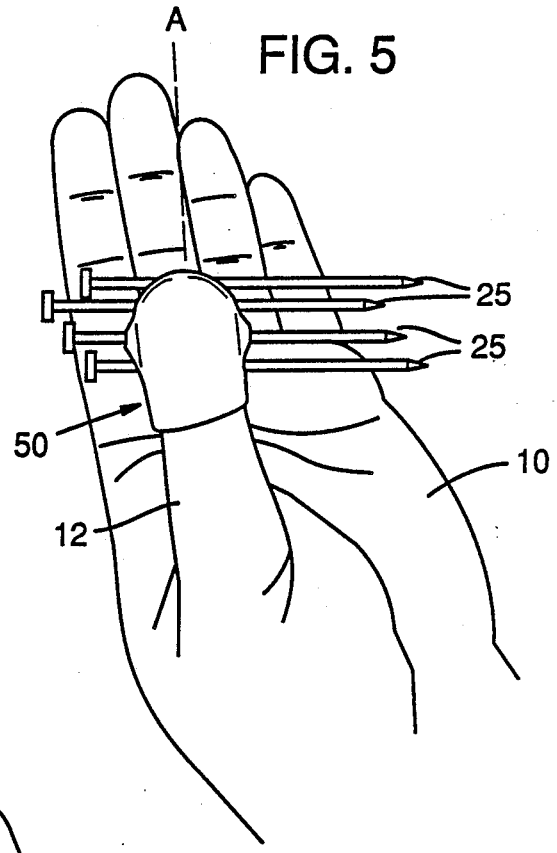
FIG. 5 is a perspective view of the tool shown in FIG. 1 when positioned on a user's thumb, the thumb extending across the palm region of the user's hand to attract and pick up a nail.
Figure 6:
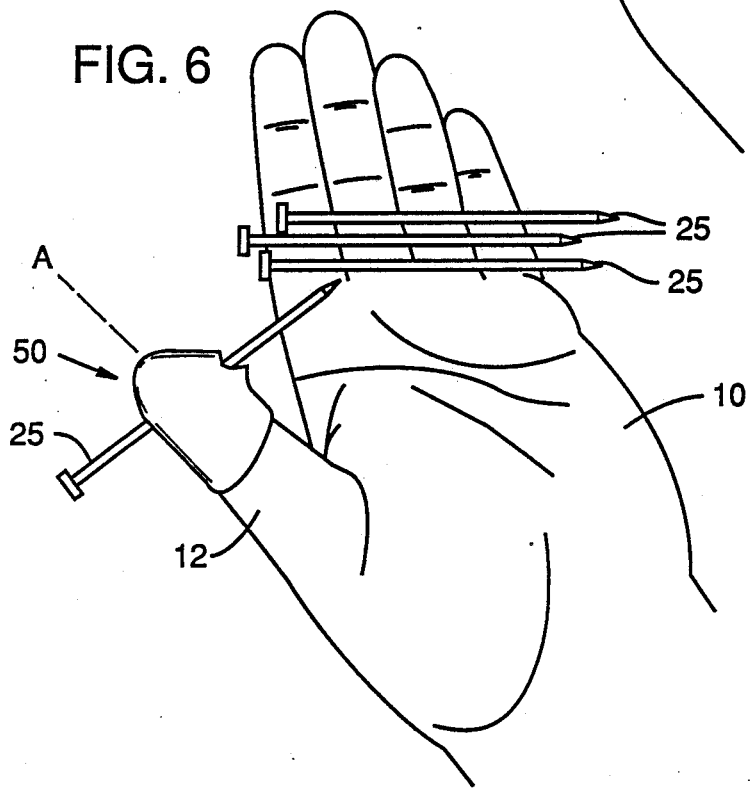
FIG. 6 is a perspective view of the tool shown in FIG. 1 after having picked up a nail, the thumb extending in a position intermediate the positions shown in FIGS. 4 and 5.

The user's hand 10 and thumb 12 depicted in FIGS. 4 to 6 is merely for purposes of illustration and is not part of the invention. The same is true of nails 25 shown in these Figures.

The Figures show a nail holding tool generally designated 50, which tool includes an impact resistant sheath 52 extending between a top end 48 and an opened lower end 49. The tool has a hollow interior region 51 sized to receive and accommodate snugly a thumb through a bottom opening 53 at lower end 49 of the sheath. The inner region 51 also has an upper thumb tip engaging surface portion which is generally opposite to the bottom opening. Sheath 52 can be made from a variety of materials that will serve to resist impact and to protect a user's thumb against misdirected hammer blows. However, a non-magnetic material such as high impact plastic is preferred in order to allow better concentration of magnetic attractive forces within the nail holding fixture described below.

An elongated groove 54 is formed between tapering sidewalls 56, 58 in outer wall surface 60 of sheath 52. A magnetic block 80 is positioned at the bottom of groove 54 in rectangular channel 62. Together, groove 54 and magnetic block 80 comprise a nail holding fixture for holding a nail below the tip of the thumb in a position extending transverse to the axis "A" of the thumb. Magnetic block 80 attracts a nail to the groove, and sidewalls 56, 58 serve to align the nail within the groove.

Figure 1:
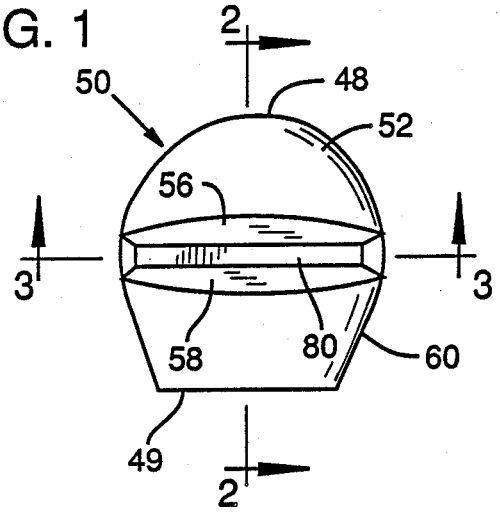
FIG. 1 is a front elevation view of a nail holding tool in accordance with the present invention.
Figure 2:
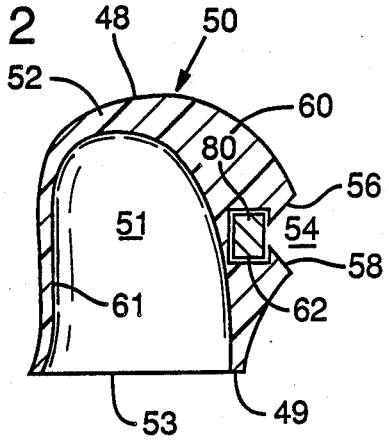
FIG. 2 is a section view taken along section line 2—2 in FIG. 1.
Figure 3:
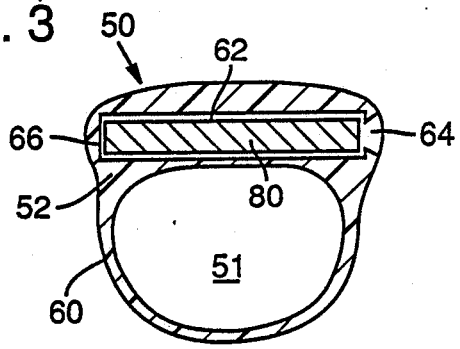
FIG. 3 is a section view taken along section line 3—3 in FIG. 1.

As best seen in FIG. 3, rectangular channel 62 is closed at one end 66, and opens through a tapered opening 64 at the opposed end. Magnetic block 80 is squeeze fitted through opening 64 to the position shown in FIGS. 1 to 3.

Various magnetic means may be used to attract and hold a nail. Ceramic magnetics which have good resistance to demagnetization and which are relatively low in cost have been found to work well.

With tool 50 positioned on a user's thumb 12 as shown in FIGS. 4 to 6, the user is able to handle several nails 25 and to access desired nailing points with relative ease. Such nails can be grasped in the user's hand 10, and picked up one-by-one with the tool. This is possible because thumb 12, in contrast to the remaining fingers of the user's hand, can easily move between the position extending away from the user's hand as shown in FIG. 4 and the position extending across the palm region of the user's hand as shown in FIG. 6.

Just before picking up a nail 25, the user's thumb 12 might be in the position shown in FIG. 4. Then, as shown in FIG. 5, thumb 12 with tool 50 reaches down to pick up one of nails 25. In FIG. 6, one of nails 25 has been picked up, and thumb 12 is returning to a position extending away from the user's hand. Once the thumb with nail 25 is extended sufficiently far away, the user would normally grasp the remaining nails 25 with his fingers (this position not being shown), and then, with suitable arm and wrist action, proceed to align and hammer the nail carried by tool 50. The user's other hand (not shown) is completely free to do the hammering job.

Thus, it will be appreciated that the location of the nail holding fixture in tool 50 below the tip of the thumb, and in a position which orients a nail transverse to the axis of the thumb takes advantage of a user's ability to close his thumb across the palm region of his hand. This enhanced dexterity is generally not possible with the remaining fingers of the user's hand, particularly if the user is handling several nails with the one hand at the same time. To enable such movement, the overall length of sheath 52 should obviously not be so long as to interfere with movement of the thumb between the positions shown in the figures.

The invention is not considered to be limited to the particular embodiment which has been described. Various modifications within the scope of the following claims are possible, and may occur to those skilled in the art.

I claim:

1. A nail holding tool, comprising:

(a) an impact resistant sheath having a top end and an open lower end, a longitudinal axis extending from said top end to said open lower end, said sheath having an inner wall surface forming a hollow interior region sized to fit snugly over a user's thumb, and an outer wall surface said inner wall surface having an upper thumb tip engaging surface portion adjacent said top end; and, (b) a nail holding fixture means supported in the outer wall surface of said sheath in a position between said thumb tip engaging surface portions and said open lower end for holding a nail below the tip of said thumb in a position extending substantially transverse to the longitudinal axis of said sheath, such that said sheath, when fitted on said thumb, can move with movement of said thumb between a position extending away from the user's hand and a position extending across the palm region of the user's hand to grip a nail held in the palm of the user's hand.

2. A nail holding tool as defined in Claim 1, said nail holding fixture means comprising an elongated groove formed in said outer wall surface of said sheath, and magnetic means at the bottom of said groove for attracting and holding a nail longitudinally in said groove.

3. A nail holding tool as described in claim 2, wherein said sheath is formed from an impact resistant plastic.

4. A nail holding tool as described in claim 2, wherein said sheath is formed from a non-magnetic impact resistant material.

* * * * *